US007934883B2

(12) United States Patent
Rolion

(10) Patent No.: US 7,934,883 B2
(45) Date of Patent: May 3, 2011

(54) WRITING INSTRUMENT COMPRISING A CARTRIDGE SUPPORT

(75) Inventor: Franck Rolion, Asnières-sur-Oise (FR)

(73) Assignee: Societe Bic, Clichy Cedex (FR)

( * ) Notice: Subject to any disclaimer, the term of this patent is extended or adjusted under 35 U.S.C. 154(b) by 879 days.

(21) Appl. No.: 11/574,303

(22) PCT Filed: Aug. 22, 2005

(86) PCT No.: PCT/FR2005/002118

§ 371 (c)(1),
(2), (4) Date: Feb. 26, 2007

(87) PCT Pub. No.: WO2006/024793

PCT Pub. Date: Mar. 9, 2006

(65) Prior Publication Data

US 2007/0297847 A1 Dec. 27, 2007

(30) Foreign Application Priority Data

Aug. 26, 2004 (FR) ..... 04 09117

(51) Int. Cl.
*B43K 24/02* (2006.01)

(52) U.S. Cl. ..... 401/109

(58) Field of Classification Search ..... 401/104–106, 401/109, 112–114, 99, 110
See application file for complete search history.

(56) References Cited

U.S. PATENT DOCUMENTS 5,145,272 A * 9/1992 Keil ..... 401/112
6,309,121 B1 * 10/2001 Ohba ..... 401/78

FOREIGN PATENT DOCUMENTS

DE 2854285 A1 6/1979
DE 9114693 U1 10/1992
FR 985249 A 7/1951

* cited by examiner

*Primary Examiner* — David J Walczak
(74) *Attorney, Agent, or Firm* — Jones Day

(57) ABSTRACT

A writing instrument that includes a barrel extending along a longitudinal axis, a cartridge housed inside the barrel and having a front end connected to a writing point and a rear end, and a cartridge support connected to the barrel and against which the rear end of the cartridge rests.

11 Claims, 1 Drawing Sheet

WRITING INSTRUMENT COMPRISING A CARTRIDGE SUPPORT

This application is a national stage application of PCT/FR05/02118, filed on Aug. 22, 2005.

FIELD OF THE INVENTION

The embodiments of the present invention relate to a writing instruments.

BACKGROUND OF THE INVENTION

More particularly, the embodiments of the present invention relates to a writing instrument comprising a barrel extending along a longitudinal axis, a cartridge housed inside the barrel and having a front end connected to a writing point and a rear end, and a cartridge support connected to the barrel and against which the rear end of the cartridge rests.

In the prior art there are supports of this sort that have a planar base approximately perpendicular to the longitudinal axis and against which the rear end of the cartridge rests. These supports have the advantage of being easy to produce and of requiring little plastics material. However, with these supports the rear end of the cartridge is not immobilized, which can have a detrimental effect on the operation of the writing-point extension and retraction mechanism and can result in clicking noises which give the user a poor impression of the quality of the instrument.

Other supports have a housing in the form of a cylindrical well in which the rear end of the cartridge is inserted more or less tightly. These supports have however the defect of being suitable for cartridges where the rear end is of an approximately constant diameter, which creates problems when it is wished to use this support with cartridges of a slightly different shape. Moreover, this kind of support requires more complex molds to form both the side walls of the support and the hollow housing into which the cartridge is inserted.

SUMMARY OF THE INVENTION

It is an object of the embodiments of the present invention to provide a cartridge support suitable for taking cartridges of substantially different shapes but without excessively increasing the amount of material and the complexity of the molding.

To this end, according to an embodiments of the present invention, a writing instrument of the kind in question is characterized in that the cartridge support comprises a base extending in a plane lying approximately transversely to the longitudinal axis and at least three teeth extending generally parallel to the longitudinal axis from the base forward, each of said teeth having an inner face turned toward the longitudinal axis and forming an acute angle with the portion of the longitudinal axis extending toward the front end from the base, the cartridge being wedged between said teeth.

By means of these provisions, the cartridge positions itself automatically between the teeth located on the base of the support when the various components of the writing instrument are assembled together, and rests against the teeth in such a way as to be approximately parallel to the longitudinal axis.

In various embodiments of the writing instrument according to the embodiments of the present invention, one or other of the following provisions may if desired also be employed:

- the inner faces are planar and define, inscribed between said faces, at least one circle lying in a transverse plane with respect to the longitudinal axis, and preferably coaxial with the base;
- each tooth has an outer face facing radially outward, and at least one lateral face extending between the inner face and the outer face, said faces of the assembly of teeth being set out with respect to each other, and each being shaped, in such a way that the assembly of teeth is demoldable in a radial direction;
- the instrument comprises three teeth, and first and second teeth are arranged outside of an acute angle, termed the clearance angle, defined by two planes parallel to the longitudinal axis and intersecting outside of the base, this angle having a vertex; and in which the third tooth is arranged inside said clearance angle;
- the third tooth has two lateral faces that form an angle whose vertex is toward the vertex of the clearance angle and is situated nearer to the vertex of the clearance angle than the first and second teeth, the lateral face of the first tooth and the lateral face of the second tooth forming preferably the clearance angle;
- the teeth are distributed at regular angular intervals;
- the cartridge is pressed against the support by means of a spring;
- the support is connected to the barrel by a mechanism for extending and retracting the writing point;
- the mechanism is a component that is integrally molded with the support.

In addition, an embodiment of the present invention also relates to a method for making a writing instrument comprising a cartridge support molding operation in which a mold is supplied in two parts that are mold halves, each part having a parting line and reliefs corresponding to the lateral faces of the teeth, and comprising the following steps:

- clamping the two mold halves against their parting line,
- injecting a plastics material, and
- demolding by separating the two mold halves in the radial demolding direction.

Other features and advantages of the invention will become apparent in the course of the following description of one of its embodiments, given by way of non-restrictive example, with reference to the enclosed drawings.

DETAILED DESCRIPTION OF THE DRAWINGS

In the various figures, identical references denote identical or similar parts.

Figure 1:
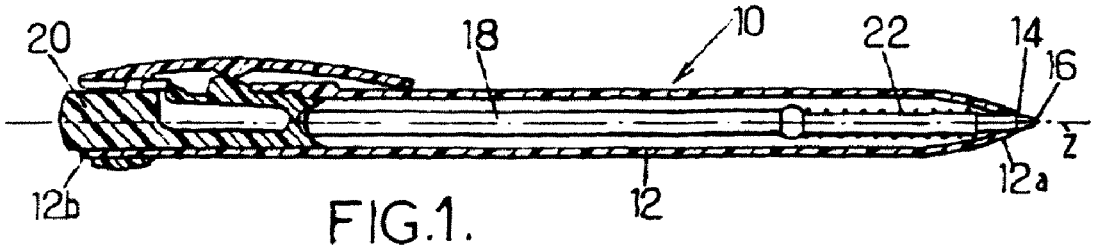
FIG. 1 is a longitudinal section through a writing instrument comprising a cartridge support of the present invention.
Figure 2:
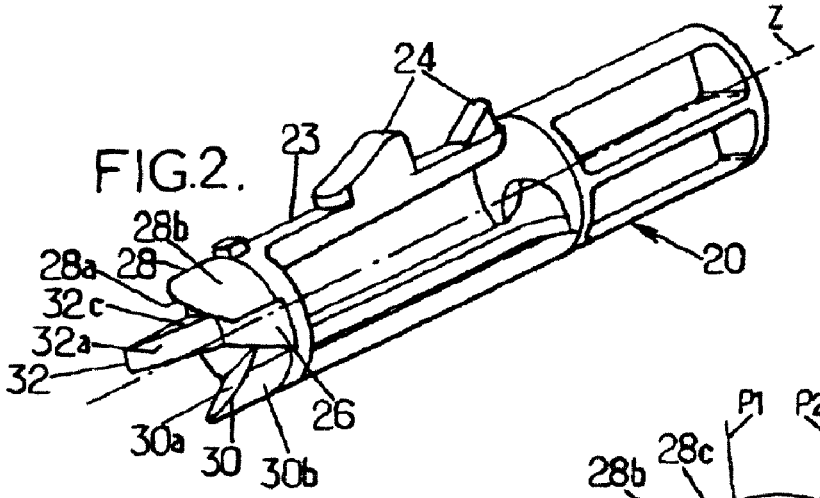
FIG. 2 is a perspective view of the cartridge support of the invention.

FIG. 1 shows a writing instrument 10 with a tubular barrel 12 extending along a longitudinal axis Z between its two ends. A front end 12*a* comprises a hole 14 for a writing point 16. Said writing point 16 is connected directly to a front end of a cartridge 18 that extends along an axis approximately parallel to the longitudinal axis Z. The second end 12*b* of the barrel accommodates a support 20 on which the rear end of the cartridge 18 rests.

The cartridge 18 is pressed against the support 20 by a spring 22 fitted between enlargements of the cartridge and the conical inside wall of the front end 12*a* of the barrel situated towards the writing point. The spring 22 acts in conjunction with a writing-point 16 extension and retraction mechanism for positioning and holding the writing point 16 in a writing position or in a storage position. The mechanism is in one piece molded integrally with the support 20. The mechanism has an elastic arm 23 with projecting buttons 24 that engage in windows formed in the barrel to lock the cartridge 18 and hence the writing point 16 in one or other of the positions described above.

The cartridge 18 rests on the support at its rear end, through at least three points of contact, giving good stability. The support 20 comprises a base 26 extending in a transverse plane perpendicular to the longitudinal axis Z. The base 26 presents a surface whose shape is essentially identical to the inside section of the barrel 12, which in this case is essentially circular, but it could be polygonal so as to slide freely with a small clearance inside the barrel 12. The base 26 is concentric with the barrel 12.

The base 26 also comprises three teeth 28, 30, 32 distributed at regular angular intervals around the circular surface of the base 26. Each tooth 28, 30, 32 extends generally parallel to the longitudinal axis Z from the base 26 toward the writing point 16. Each of the three teeth 28, 30, 32 has an inner face 28*a*, 30*a*, 32*a* turned toward the longitudinal axis Z and forming an acute angle with the longitudinal axis, so that the vertex of the angle formed by the intersection of the longitudinal axis Z with the plane defined by the inner face 28*a*, 30*a*, 32*a* of a tooth 28, 30, 32 is directed toward the rear end 12*b* of the barrel 12.

The slope of the inner faces 28*a*, 30*a*, 32*a* of the teeth 28, 30, 32 guides the rear end of the cartridge 18 toward a position in which the cartridge 18 is in contact with and therefore wedged between all three teeth, and this applies to cartridges, the diameter of whose rear end may vary significantly. With a smaller diameter cartridge 18 it is also possible for its rear end to rest directly on the base, the teeth 28, 30, 32 keeping it central.

The inner faces 28*a*, 30*a*, 32*a* of the three teeth 28, 30, 32 are planar and define a plurality of circles inscribed between them situated in a transverse plane perpendicular to the longitudinal axis coaxial with the base 26. This arrangement will guide the rear end of the cartridge 18 concentrically.

If the dimensions of the cartridge 18 are equal to the dimensions of one of the inscribed circles mentioned above, the rear end of the cartridge will rest on one point of each of the three teeth.

The teeth 28, 30, 32 also have an outer face 28*b*, 30*b*, 32*b* facing radially outward and having a convex shape that matches the inside wall of the barrel 12, so as to slide inside the latter.

Figure 3:
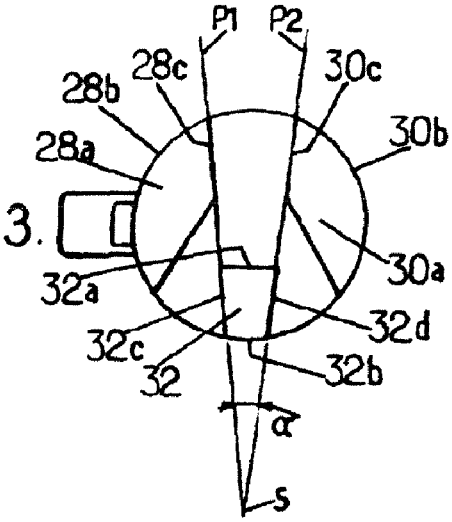
FIG. 3 is an end view of the cartridge support.

A first tooth 28 and a second tooth 30 both have a single lateral face 28*c*, 30*c* that extends between the inner face 28*a*, 30*a* and the outer face 28*b*, 30*b*. A third tooth 32 has two lateral faces 32*c*, 32*d* extending between the inner face 32*a* and the outer face 32*b*. As shown in FIG. 3, the lateral face 28*c* of the first tooth 28 lies in a plane P1 containing the lateral face 32*c* of the third tooth 32, and the lateral face 30*c* of the second tooth 30 lies in a plane P2 containing the second lateral face 32*d* of the third tooth 32.

The abovementioned planes P1, P2 are perpendicular to the base 26 and parallel to the Z axis. They form an angle α termed the clearance angle, and intersect along a straight line situated outside of the base 26. In FIG. 3 a point on this straight line is represented by the reference S which is the vertex of the angle α. The angle formed by the two planes, clearance angle α, is approximately 5 in the embodiment illustrated, but could be between 2 and 15, to facilitate demolding without making the teeth too small.

The vertex S of the clearance angle α is on the same side as the third tooth 32, making the third tooth 32 nearer to the vertex S of the clearance angle α than the first 28 and second 30 teeth.

In a variant, the third tooth 32 could lie within the clearance angle α with lateral faces 32*c*, 32*d* forming an angle pointing toward the vertex S of the clearance angle α. The lateral faces 32*c*, 32*d* would not then be coplanar with the lateral faces 28*c*, 30*c* of the first 28 and second 30 teeth.

The arrangements described above enable the cartridge 18 to be wedged into the support 20 easily, quickly and reversibly. Assembly is therefore possible with comparatively generous manufacturing tolerances, thus reducing the cost of manufacture.

Also, the arrangement of the teeth 28, 30, 32 makes for easier manufacture. This will be explained as the text proceeds.

The teeth 28, 30, 32 are molded in a mold 36 made up of two parts 38, 40 taking the form of mold halves. Each part of the mold 36 has reliefs corresponding to the lateral faces and to the inner faces of the teeth.

Figure 4:
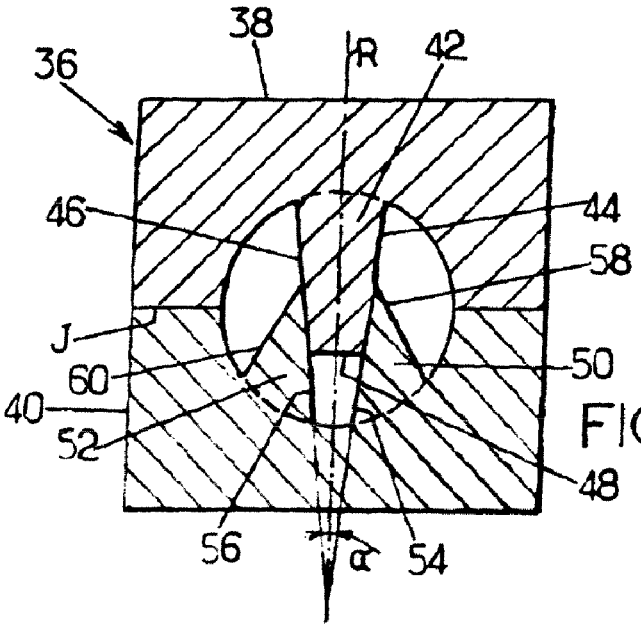
FIG. 4 is a transverse section through a mold suitable for making the cartridge support.

FIG. 4 is a transverse section through the mold 36 when the two parts 38, 40 are brought together to form the cavity for the teeth 28, 30, 32 on the base 26. In this figure, hatched parts correspond to the cross section through the two parts 38, 40 of the mold 36: these will be slightly in front of the base 26 of the support 20 during molding. The two parts of the mold extend past the circle bounded by the base 26, and have a parting line J.

The term "relief" will be used to denote the mold parts shown inside the circle drawn in dashes in FIG. 4, this circle representing the perimeter of the base 26.

The first part 38 of the mold comprises a parallelepiped-shaped relief 42 in which two opposite faces 44, 46 are designed to mold the lateral faces 28*c*, 30*c* of the first and second teeth 28, 30, and a central face 48 is designed to mold the inner face 32*a* of the third tooth 32.

The other reliefs 50, 52 shown in FIG. 3 belong to the second part 40 of the mold 36. These other reliefs 50, 52, termed the second reliefs, each present the shape of a triangle whose sides nearest each other 54, 56 form the cavity of the lateral faces of the third tooth and whose opposite sides 58, 60 form the inner faces 28*a*, 30*a* of the first 28 and second 30 teeth, respectively.

The two opposite faces 44, 46 of the first relief 42 lie in planes meeting at an angle approximately equal to the clearance angle α referred to earlier. Hence, after molding, the lateral faces 28*c*, 30*c* of the first and second teeth 28 and 30 are oriented with respect to each other at said clearance angle α.

The sides 54, 56 of the second reliefs 50, 52 of the mold, which form the cavity of the lateral faces 32*c*, 32*d* of the third tooth 32, are also oriented with respect to each other at said clearance angle α, because the sides 54, 56 of the second reliefs 50, 52 each lie in the same plane as each of the two opposite sides 44, 46 of the first relief 42.

After molding, therefore, each lateral face 32*c*, 32*d* of the third tooth 30 lies in the same plane as the lateral face 28*c* of the first tooth and as the lateral face 30*c* of the second tooth, respectively. This is advantageous because the mold has reliefs that are simpler to make.

The second reliefs 50, 52 of the mold 36 combine with the first relief 42 to form the other faces of the various teeth 28, 30, 32.

After injection of the material, the two parts 38, 40 of the mold 36 are withdrawn along a radial line R relative to the longitudinal axis Z and in opposite directions. In FIG. 4 this line is the bisector of the clearance angle α.

The inner, lateral and outer faces of the teeth 28, 30, 32 present a normal direction or a curvature oriented in such a way as to be able to be demolded along the radial direction R.

These arrangements make it easy to demold the base 26 with the teeth 28, 30, 32 along a radial direction.

In order to be able to use the two-part mold demold the parts easily, the clearance angle α and the angle formed by the two lateral faces 32*c*, 32*d* of the third tooth 32 must have their vertex S in the same direction.

If the lateral faces 32*c*, 32*d* of the third tooth 32 form an angle other than the clearance angle α, the width of the inner face 32*a* of the third tooth 32 must be within the clearance angle α.

These arrangements ensure easy demolding of the base 26 and of the teeth 28, 30, 32.

The invention claimed is:

1. A writing instrument comprising:

a barrel extending along a longitudinal axis;

a cartridge housed inside said barrel and having a front end connected to a writing point and a rear end; and a cartridge support connected to said barrel and against which the rear end of said cartridge rests, wherein said cartridge support includes a base extending in a plane lying approximately transversely to the longitudinal axis and at least three teeth extending generally parallel to the longitudinal axis from the base forward, said base defining a transverse face and said at least three teeth extending axially from said transverse face, each of the teeth having an inner face turned toward the longitudinal axis and forming an acute angle with the portion of the longitudinal axis extending toward the front end from the base, said cartridge being wedged between the teeth.

2. The writing instrument according to claim 1, wherein the inner faces are planar and define, inscribed between the faces, at least one circle lying in a transverse plane with respect to the longitudinal axis, and coaxial with the base.

3. The writing instrument according to claim 2, wherein each tooth has an outer face facing radially outward and at least one lateral face extending between the inner face and the outer face, the faces of the assembly of teeth being set out with respect to each other, and each being shaped in such a way that the assembly of teeth is demoldable in a radial direction.

4. The writing instrument according to claim 3, wherein the first and second teeth are arranged outside of an acute angle, termed the clearance angle, defined by two planes parallel to the longitudinal axis and intersecting outside of the base, this angle having a vertex; and in which the third tooth is arranged inside the clearance angle.

5. The writing instrument according to claim 4, wherein the third tooth has two lateral faces that form an angle whose vertex is toward the vertex of the clearance angle and is situated nearer to the vertex of the clearance angle than the first and second teeth, the lateral face of the first tooth and the lateral face of the second tooth forming the clearance angle.

6. The writing instrument according to claim 5, wherein the teeth are distributed at regular angular intervals.

7. The writing instrument according to claim 1, wherein said cartridge is pressed against said cartridge support by means of a spring.

8. The writing instrument according to claim 1, wherein said cartridge support is connected to said barrel by a mechanism for extending and retracting the writing point.

9. The writing instrument according to claim 8, wherein the writing-point extension and retraction mechanism is a component molded integrally with the support.

10. A writing instrument comprising:

a barrel extending along a longitudinal axis;

a cartridge housed inside said barrel and having a front end connected to a writing point and a rear end; and a cartridge support connected to said barrel and against which the rear end of said cartridge rests, wherein said cartridge support includes a base extending in a plane lying approximately transversely to the longitudinal axis and at least three teeth extending generally parallel to the longitudinal axis from the base forward, said base defining a transverse face and said at least three teeth extending axially from said transverse face, each of the teeth having an inner face turned toward the longitudinal axis and forming an acute angle with the portion of the longitudinal axis extending toward the front end from the base, said cartridge being wedged between the teeth, and wherein the inner faces are planar and define, inscribed between the faces, at least one circle lying in a transverse plane with respect to the longitudinal axis, and coaxial with the base.

11. A writing instrument comprising:

a barrel extending along a longitudinal axis;

a cartridge housed inside said barrel and having a front end connected to a writing point and a rear end; and a cartridge support connected to said barrel and against which the rear end of said cartridge rests, wherein said cartridge support includes a base extending in a plane lying approximately transversely to the longitudinal axis and at least three teeth extending generally parallel to the longitudinal axis from the base forward, said base defining a transverse face and said at least three teeth extending axially from said transverse face, each of the teeth having an inner face turned toward the longitudinal axis and forming an acute angle with the portion of the longitudinal axis extending toward the front end from the base, said cartridge being wedged between the teeth, wherein the inner faces are planar and define, inscribed between the faces, at least one circle lying in a transverse plane with respect to the longitudinal axis, and coaxial with the base, and wherein each tooth has an outer face facing radially outward, and at least one lateral face extending between the inner face and the outer face, the faces of the assembly of teeth being set out with respect to each other, and each being shaped in such a way that the assembly of teeth is demoldable in a radial direction.

* * * * *